United States Patent [19]

Vuissoz, deceased et al.

[11] 4,380,430

[45] Apr. 19, 1983

[54] CENTRAL HEATING APPARATUS

[75] Inventors: Constant Vuissoz, deceased, late of Grone, Switzerland, by Marie Vuissoz-de Preux, heir; by Cesarine Mosoni-Vuissoz, heir, Granges; by Suzanne Voide-Vuissoz, heir, Rechy, both of Switzerland

[73] Assignee: Limtel, Ltd., Great Britain

[21] Appl. No.: 241,526

[22] Filed: Mar. 9, 1981

[30] Foreign Application Priority Data

Mar. 11, 1980 [CH] Switzerland ..... 1877/80

[51] Int. Cl.[3] ..... F23D 13/12

[52] U.S. Cl. ..... 431/347; 431/171

[58] Field of Search ..... 431/171, 347; 126/92 AC

[56] References Cited

U.S. PATENT DOCUMENTS 1,486,036 3/1924 Risinger ..... 126/92 AC 3,251,393 5/1966 Beach et al. ..... 431/347

FOREIGN PATENT DOCUMENTS 2656798 7/1977 Fed. Rep. of Germany ..... 431/171

*Primary Examiner*—Edward G. Favors

*Attorney, Agent, or Firm*—Robert E. Burns; Emmanuel J. Lobato; Bruce L. Adams

[57] ABSTRACT

This central heating apparatus for oil burner and boiler systems comprises a detachable structure disposed in the boiler furnace between the burner and the boiler; the structure comprises essentially a base frame supporting a vertical upright rigidly welded thereto and to which an assembly of stacked elements are secured by means of a common and single belt substantially aligned with the burner; this assembly comprises a pyramidal front member facing the burner, followed by a fan-like assembly of radial blades and, bearing against the upright, a perforated plate of which the holes are so punched that their material forms protruding fins directed towards the burner flame and adapted to become white hot in order to improve the combustion and eliminate soot deposits and the release of excess smoke.

7 Claims, 5 Drawing Figures

Fig. 1
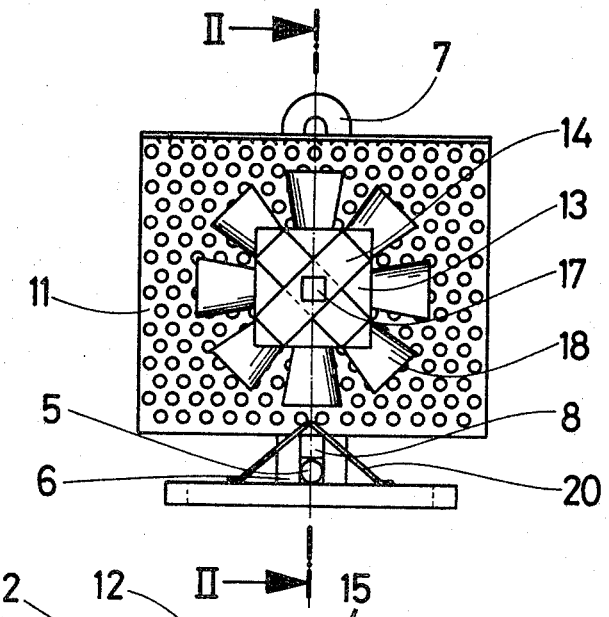
Fig. 2
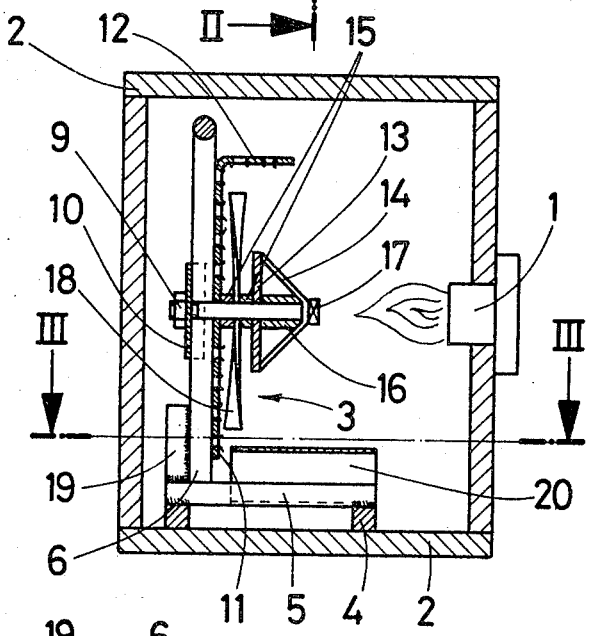
Fig. 3
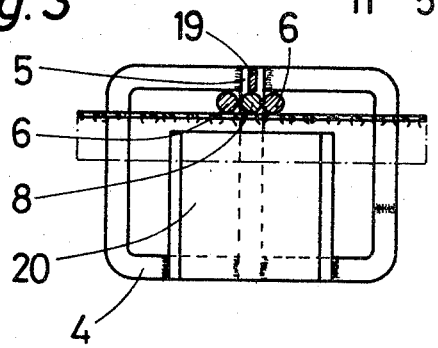
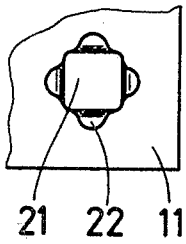
Fig. 4
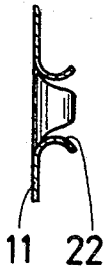
Fig. 5

CENTRAL HEATING APPARATUS

BACKGROUND OF THE INVENTION

The present invention relates to a central heating apparatus comprising a boiler and an oil burner with, interposed between the burner and the boiler walls, a detachable, flame-permeable structure consisting of juxtaposed elements coupled through fastening means to a support having a base portion bearing upon the floor of the boiler furnace, this structure being adapted to be heated white hot in order to improve the combustion and therefore reduce the release of smoke and soot deposits in the furnace.

THE PRIOR ART

Apparatus of this type are already known, as disclosed notably in the Swiss Pat. Nos. 606,907 and 610,642.

SUMMARY OF THE INVENTION

It is the primary object of this invention to further improve the efficiency of prior art apparatus of this character by providing on said flame-permeable structure specific points capable of reaching extremely high temperatures very quickly after the burner ignition.

For this purpose, the invention provides a structure of the type broadly set forth hereinabove but comprising at least one perforated sheet-metal element, wherein the edges of each perforation constitute protruding fins directed towards the flame.

The essential advantageous feature characterizing this invention is the surprising effect produced by the protruding fins of said structure which provide as many hot spots which, from the very onset of the ignition, become incandescent and assist in ensuring a good combustion while preserving their efficiency even when the burner is operated with a very low flame. The protruding fins surrounding the holes are also capable of producing a relatively strong turbulence contributive to a complete fuel-oil combustion.

The structure according to the present invention is adapted to be disposed within the boiler furnace after removing the necessary number of refractory bricks. If desired, bricks may be left on the boiler floor in order to level and centre the structure with respect to the flame. With this structure it is possible to convert the normal flame of the burner into a bluish, considerably hotter flame passing through a permanent live fire before reaching the boiler containing the circulation water. This very hot flame eliminates a very frequent source of pollution for it burns completely all the component elements of the fuel-oil and prevents the sooting-up of the boiler, burner and stack, even if low-grade oil is used.

With this invention, it is useless to keep firebricks between the boiler wall and the structure as currently done in conventional central heating systems for isolating the boiler and reverberate heat towards the burner in order to prevent the latter from sooting up. The presence of the structure of this invention is sufficient for preventing any detrimental sooting up of the burner, and at the same time the boiler is not attached by the flames overheated by this structure.

The details concerning a typical form of embodiment of the invention will now be given by way of example with reference to the accompanying drawings.

THE DRAWINGS

FIG. 1 is a diagrammatical front elevational view of the structure;

FIG. 2 is a vertical section taken along the line II—II of FIG. 1;

FIG. 3 is a plan view of the structure alone, and

FIGS. 4 and 5 are a front view and a sectional view, respectively, of a typical, single perforation with its protruding fins.

DESCRIPTION OF THE PREFERRED EMBODIMENT

A preferred embodiment of the invention illustrated by way of example in the drawings comprises a boiler having walls 2 defining a combustion chamber. A burner nozzle 1 projects a flame into the combustion chamber toward an opposite wall thereof. Between the nozzle 1 and the opposite wall of the combustion chamber there is a detachable structure 3.

The detachable structure 3 comprises a rectangular base frame 4 consisting of a section member bent at right angles at the four corners and welded end to end. Welded to this frame 4 is a central cross member 5 having secured thereto also by welding an upright 6 consisting of a bar bent to a hairpin configuration at 7. Inserted between the lower portions of the side legs of this upright 6 is a vertical spacer 8 consisting of a section member welded to said legs and also to cross member 5, and reinforced by a plate 19 welded thereto along its inner edge.

Thus, the upright 6 constitutes a kind of slideway to which the operative portion of the structure is adapted to be locked at the selected level. The welds of upright 6, spacer 8 and cross member 5 are protected by a screen 20 consisting of a sheet-metal element bent to a roof-shaped configuration and welded to the base frame 4.

The operative portion of the structure, in the space extending from the face registering with the flame produced by the nozzle of the burner, comprises sheet-metal cross members 14 bent and assembled to constitute a pyramidal element pressed against a plate 13 with the interposition of a tubular distance-piece 16. Next to plate 13 is a fan-like assembly of radial blades 18. The relative spacing between these component elements is maintained positively by means of rings 15. This structure is completed by a relatively large perforated sheet-metal member 11, 12 bearing against the slideway-forming upright 6, this structure being mounted on a central bolt 17 and tightened in position by a nut 9 with the interposition of a plate 10.

The perforations made through the sheet 11, 12 constitute an essential feature of the present invention. The material of the holes formed in the sheet is not removed but punched to provide protruding burs or fins 22 directed towards the flame. It is of course an easy matter to form these fins by using square-sectioned pyramidal punches cooperating with a die in which round holes are formed.

Other perforated plate arrangements may be devised by those skilled in the art without departing from the basic principle of the invention. Thus, the perforated plate 11 may be either flat or bent at its upper portion 12 as shown in the drawings, but if desired the plate may also be bent along its lateral edges.

All the component elements of the structures are made from high-grade steel stock capable of withstanding high temperatures.

What is claimed is:

1. In a central heating apparatus comprising a boiler having walls defining a combustion chamber, a burner nozzle projecting a flame into the combustion chamber toward an opposite wall thereof, and a flame-permeable structure interposed between the nozzle and said opposite wall, the improvement that said flame-permeable structure comprises at least one flame-resistant sheet metal plate disposed in a plane approximately perpendicular to the direction of projection of said flame and having therein a multiplicity of small perforations formed by a piercing tool without removal of material to provide around the edge of each perforation protruding burs directed toward said nozzle, said burs being heated white-hot by the flame in order to improve fuel combustion and thereby reduce the release of smoke and soot deposits in the combustion chamber.

2. A central heating apparatus according to claim 1, wherein each of said perforations with surrounding burs is formed by a square-sectioned pryramidal punch cooperating with a die having a round hole.

3. A central heating apparatus according to claim 1, wherein an upper part of said plate is bent toward said nozzle at approximately right angles to the plane of the main part of said plate.

4. A central heating apparatus according to claim 1, wherein said flame-permeable structure further comprises a pyramidal structure interposed between a central portion of said plate and said nozzle, said pyramidal structure comprising a square base and crossed strips of sheet metal bent to pyramidal form with ends joined to edges of said base and central portions spaced from said base by a spacer, said pyramidal structure having its apex facing said nozzle.

5. A central heating apparatus according to claim 4, wherein said flame permeable structure further comprises a fan-like assembly interposed between and spaced from said perforated plate and said base, said fan-like assembly comprising spaced radial blades projecting beyond the periphery of said base.

6. A central heating apparatus according to claim 5, wherein said flame-permeable structure further comprises a base frame adapted to rest on the bottom of said combustion chamber, an inverted U-shaped upright extending up from said base frame and a single bolt passing through said perforated plate, said fan-like assembly, said pyramidal structure and said upright to clamp said perforated plate, said fan-like assembly and said pyramidal structure to said upright in selected height-wise position.

7. A central heating apparatus according to claim 1, wherein said flame permeable structure further comprises a base frame, an inverted U-shaped upright on which said perforated plate is mounted welded to and extending up from said base frame, and a roof-shaped screen over said base frame to protect weld seams of said upright and base frame from the burner flame.

* * * * *